United States Patent [19]

Seymour

[11] Patent Number: 4,753,350

[45] Date of Patent: Jun. 28, 1988

[54] DISPLAY AND PACKAGING DEVICE FOR A FLASHLIGHT

[75] Inventor: Richard W. Seymour, Petersham, England

[73] Assignee: Duracell Inc., Bethel, Conn.

[21] Appl. No.: 933,001

[22] Filed: Nov. 20, 1986

[51] Int. Cl.[4] ..... B65D 5/50; B65D 73/00

[52] U.S. Cl. ..... 206/476; 206/486; 206/806

[58] Field of Search ..... 206/476, 486, 461, 462, 206/806

[56] References Cited

U.S. PATENT DOCUMENTS

| | | | |
|---|---|---|---|
| 3,408,758 | 11/1968 | Doring | 206/486 X |
| 4,046,251 | 9/1977 | Bruml | 206/476 X |
| 4,354,598 | 10/1982 | Schillinger | 206/476 X |
| 4,531,637 | 7/1985 | Cusmano | 206/806 |
| 4,549,654 | 10/1985 | Tiesman | 206/476 X |

*Primary Examiner*—William Price

*Attorney, Agent, or Firm*—Ronald S. Cornell; James B. McVeigh

[57] ABSTRACT

A flashlight, or the like, is suspended at its upper end in a semi-circular loop that is dependent from a generally flat body portion. A tab or flap located above the loop is seated against an upper region of the flashlight.

8 Claims, 7 Drawing Sheets

Figure 1:
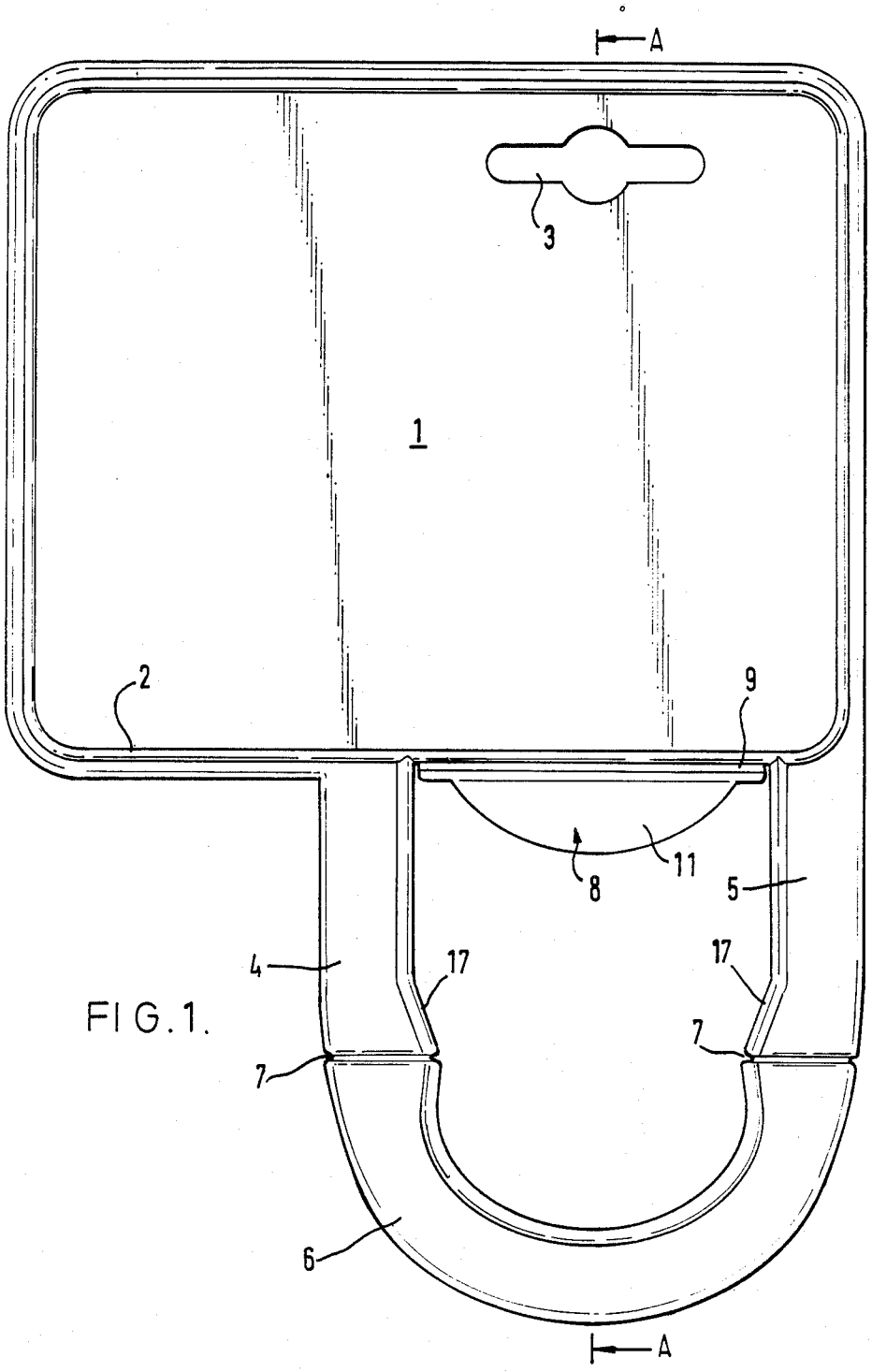

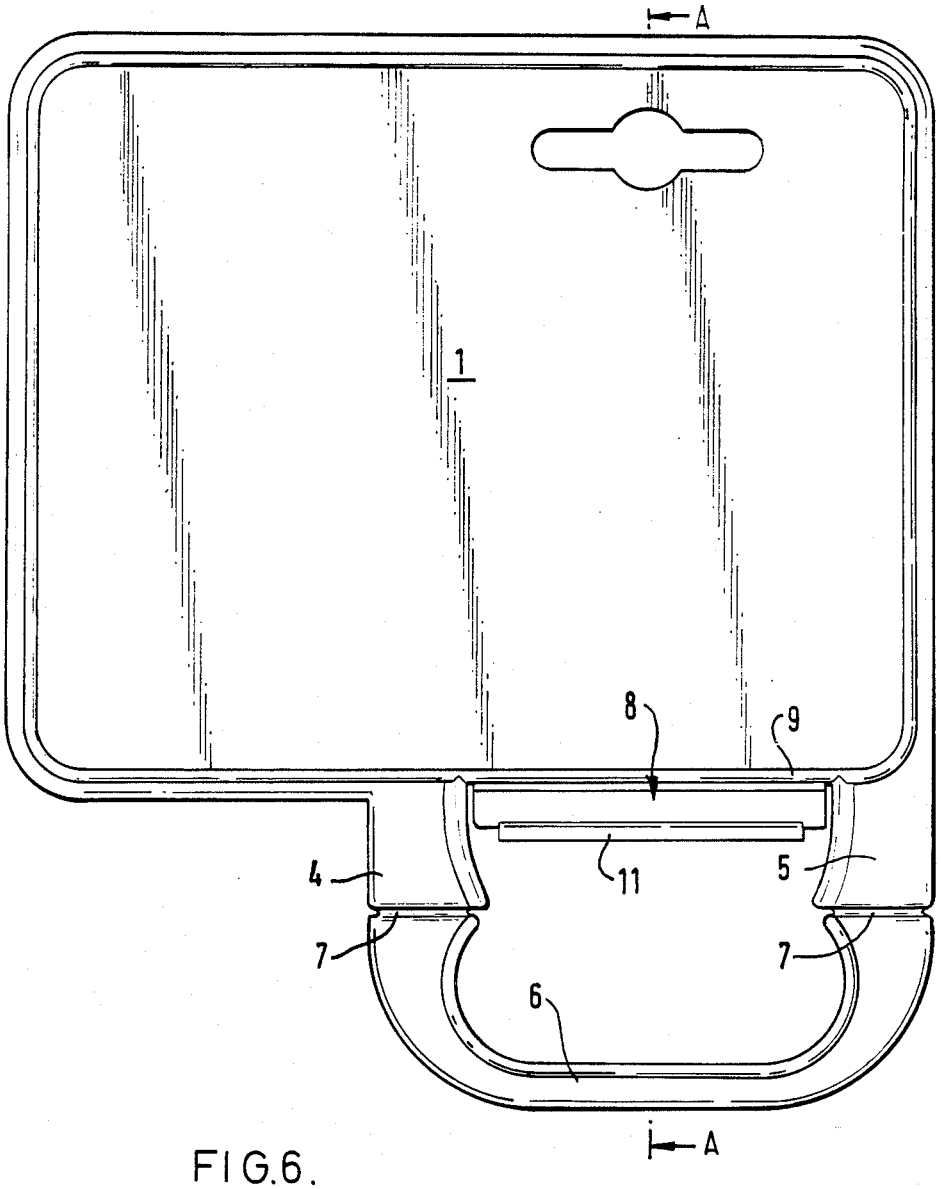
FIG.6.
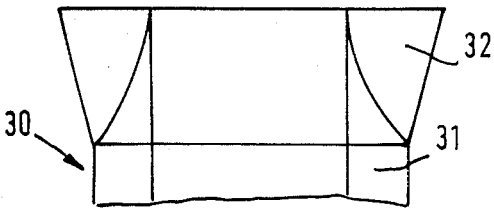

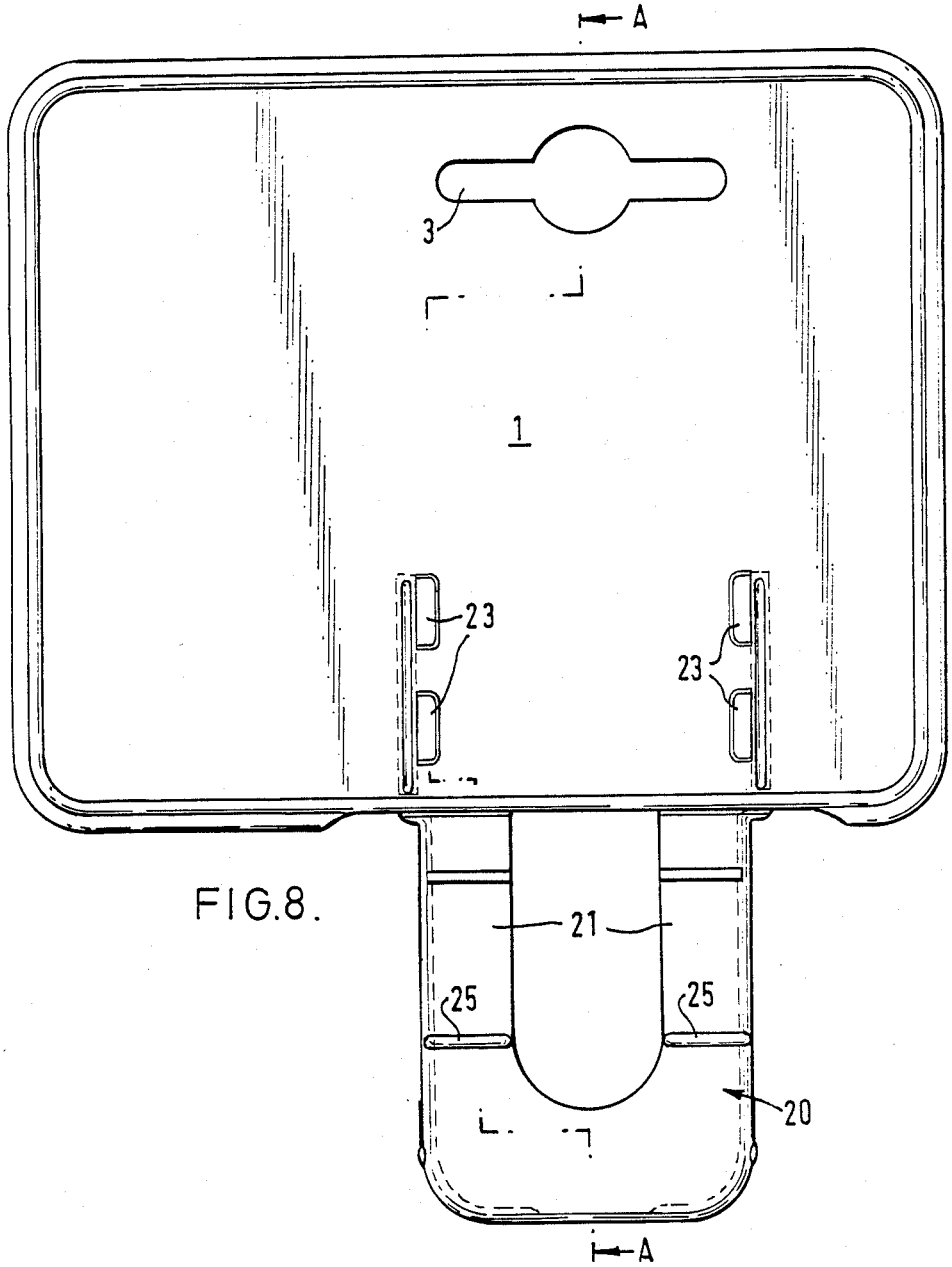
FIG.8.
FIG.9.
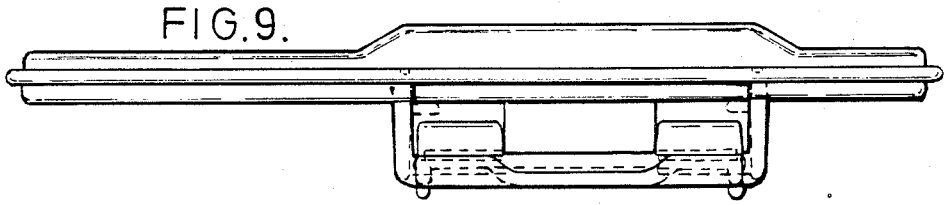

DISPLAY AND PACKAGING DEVICE FOR A FLASHLIGHT

This invention relates to display packaging for articles. The invention is particularly but not exclusively applicable to the packaging of torches, flashlights and the like for point of sale display.

In the sale of a torch, and many other items, the appearance and feel of the article are important factors in the customer's decision to buy. It is therefore quite important that point of sale display and packaging should allow the customer to see and if possible handle the article. From this point of view, conventional packaging in boxes is extremely inconvenient and there is a marked trend towards forms of packaging which do not enclose the articles, and in particular, packaging by means of cards or open packs designed to be hung from display stand pegs.

According to one aspect of the present invention, a display and packaging device comprises a generally flat body portion, capable of being suspended, a generally semi-circular dependent loop pivotable on the body portion about an axis arranged to be horizontal when the body portion is suspended, for embracing a portion of the circumference of an article to be packaged and displayed, and a flap or tab above the loop, also pivotable on the body portion about a horizontal axis, for seating against an upper region of the article, whereby the loop and tab together hold the articles for display in a manner allowing easy removal and replacement of the article.

In a preferred embodiment the flap or tab has an opposite direction of pivoting from the loop.

It will normally be necessary that the article have a lateral configuration or abutment adapted for seating on the loop, and an upper configuration or abutment for seating against the edge of the tab. In the case of a torch or the like, the upper abutment is conveniently a rim or bezel around the lens of the torch, the lower abutment can be a shoulder, groove or rib on the side of the torch, or the underside of an enlarged head portion of the torch.

The invention further resides in a display and packaging device, for a torch having a body with a lateral abutment adjacent a lens end of the torch, a recessed lens in the said end, and a rim for the lens, which device comprises: a generally flat body portion adapted to be suspended; a dependent loop of substantially half-circle extent, having its ends attached to the body portion with the body portion extending above the loop thereby defining a window between the loop and the body portion, the loop having a torch-holding position in which it extends obliquely to one side of the vertical when the body portion is suspended, the loop when in the said position being arranged to engage laterally and under the said abutment of a torch inserted in the window with its lens uppermost, whereby the torch is suspended in the loop; and a tab attached to the body portion within the upper region of the window and having a torch-retaining position in which it extends to the other side of the vertical when the body portion is suspended, in which position it is arranged to seat over the lens and against the inner side of the rim of a torch suspended in the loop, for retaining the torch.

The invention further provides a display and packaging device for an article having a body, a projection extending from an edge of the body, and an abutment provided on a face of the body, which device comprises: a generally flat body portion adapted to be suspended, at least one dependent limb spaced laterally from the plane of the body portion, and means defining a slot parallel to the body portion on the same side thereof as and above the limb or limbs; the arrangement being such that the article can be seated against the limb(s) and a lower edge of the body portion adjacent the limb(s) with its said projection extending upwards in the slot, the limb(s) having a suspension projection arranged to engage the said abutment of the article for suspending the article.

The packaging and display device is preferably an integral body of moulded plastics material, in particular injection moulded polypropylene or polyethylene.

The body portion of the device may be used for advertising and display material, comprising for example text and/or pictures.

Figure 2:
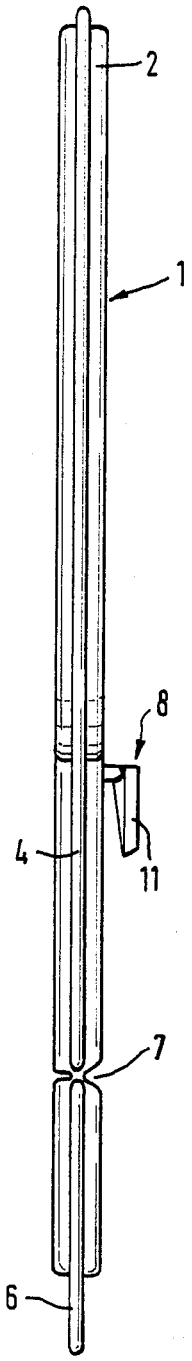
Figure 3:
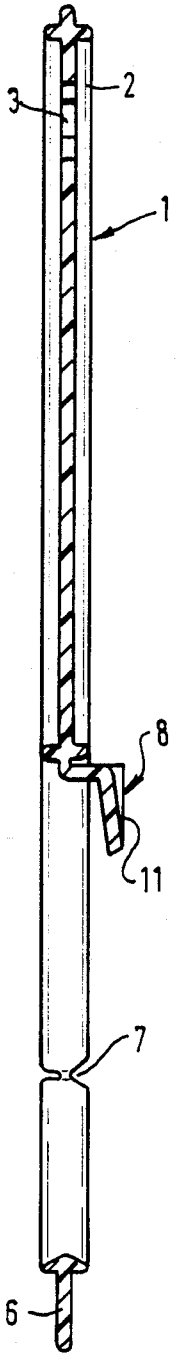
Figure 4:
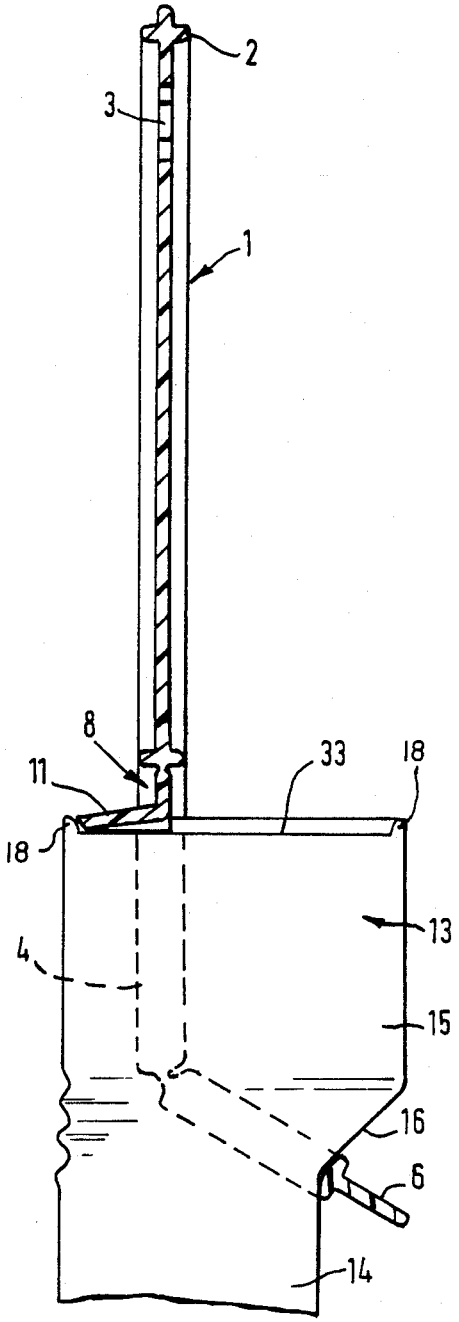
Figure 5:
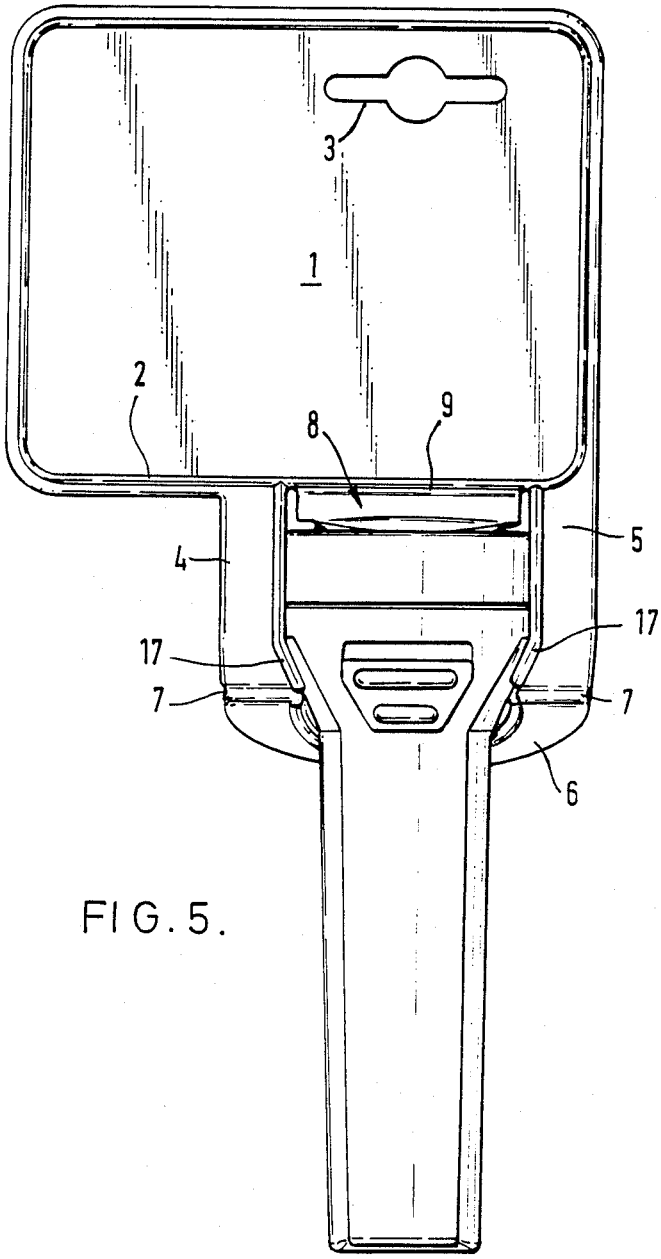
Figure 7:
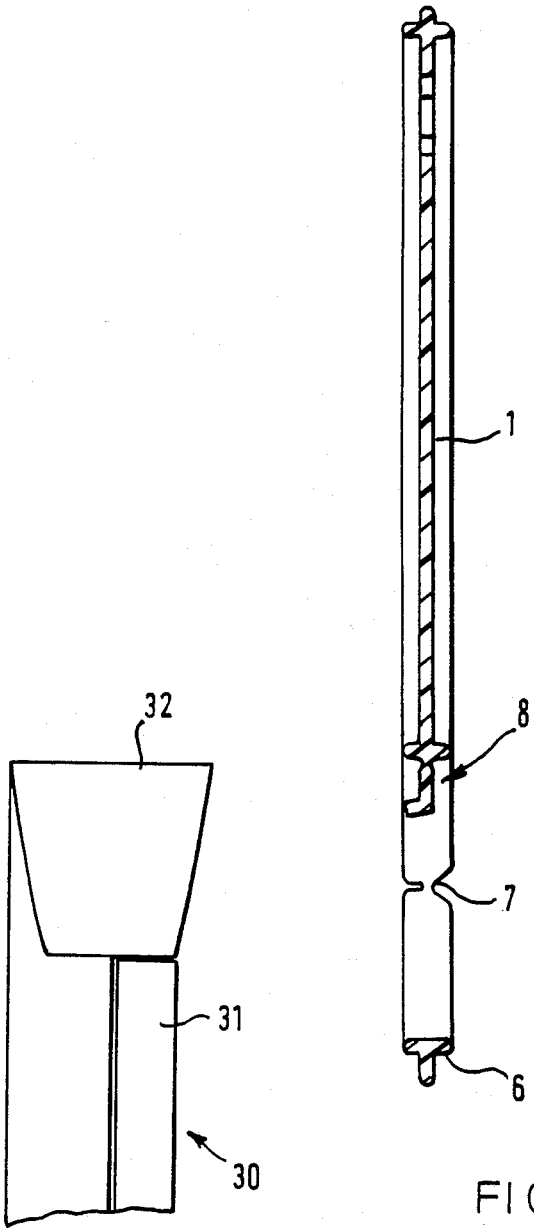
Figure 10:
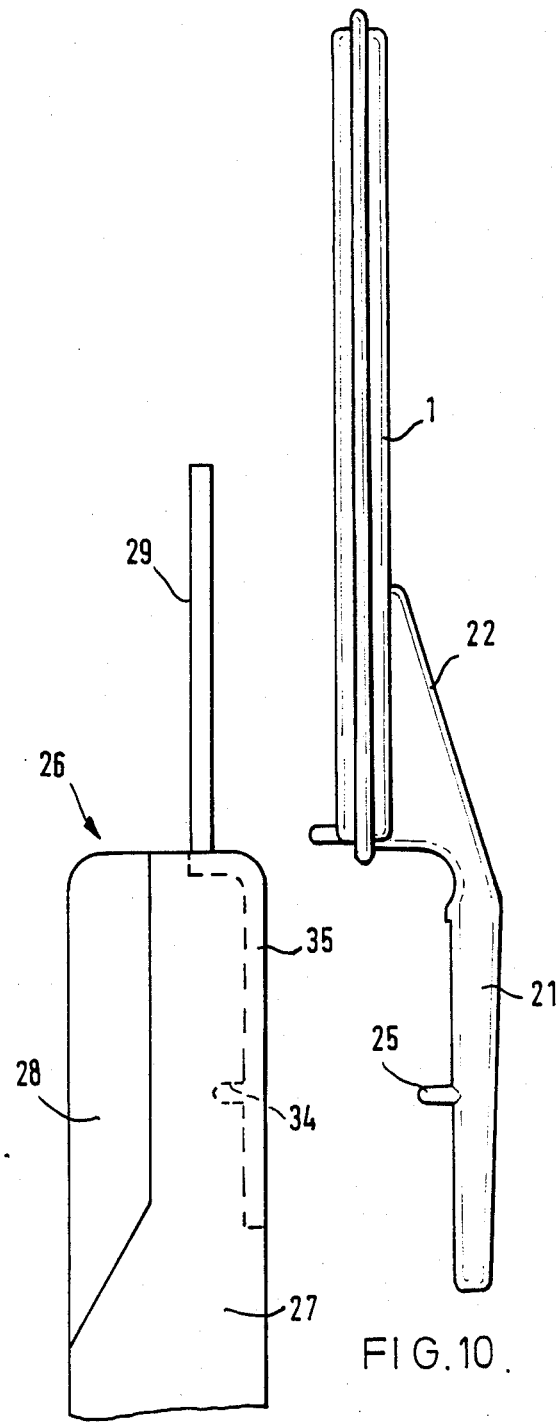
Figure 11:
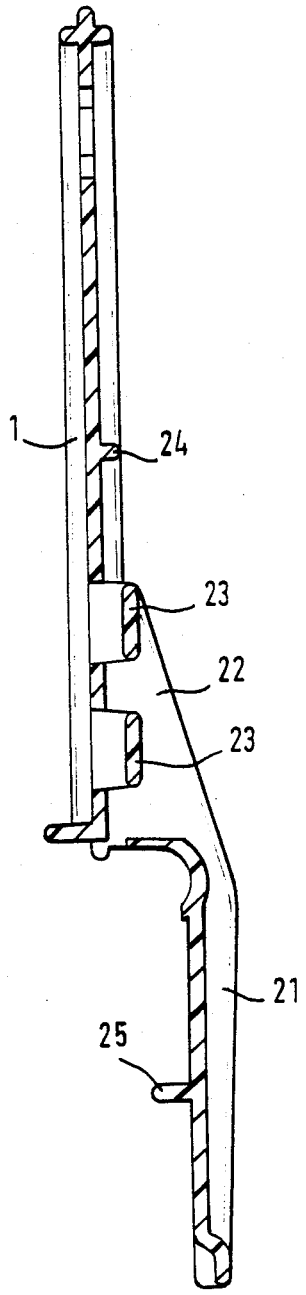

The invention will be further described with reference to the accompanying drawings, in which:

FIG. 1 is a front elevation of a first packaging device embodiments the invention, for a hand torch, FIG. 2 is a side view of the same device, FIG. 3 is a vertical section through the same device, FIG. 4 is a vertical section showing a hand torch fitted into the device of FIGS. 1 to 3, FIG. 5 is a front view of the device and hand torch, FIGS. 6 and 7 are front and section views of a device embodying the invention for packaging a flat pocket torch, FIGS. 8 to 11 are respectively front, top and side views and a vertical section, of a further packaging device for packaging a flat torch.

The packaging device illustrated in FIGS. 1 to 4 has a generally rectangular panel 1 with a raised rim 2, and a suspension slot 3 near one edge, for hanging the packaging on a peg of a display stand or the like. The panel 1 constitutes or carries a label for the product, on one or both sides.

From the lower edge of the panel, legs 4, 5 project downwards, below the hanging slot 3. Each leg is attached to a respective end of a loop 6 through a hinge 7 of which the axis is horizontal when the device is hung from the slot 3. The hinges 7 have collinear axes, parallel to the plane of the panel 1, so as to be horizontal when the panel is suspended at slot 3.

On the lower edge of the panel, between the legs 4, 5, a tab 8 is hinged to the panel by a hinge 9 parallel to the hinges 7. The tab 8 is L-shaped in side view. The hinges 9 are connected between the lower edge of the panel 1, and one arm 10 of the L. The other arm 11 of the tab 8 has a part-circular profile. In the rest position illustrated in FIGS. 1 to 3, the arm 11 stands clear of the panel 1, on the projecting end of the arm 10. The hinges 7 are so designed that the loop 6 can pivot towards that side of the panel on which the arm 11 lies in its rest position, but not in the opposite direction.

The illustrated display device can be manufactured of any convenient material, for example card, but is preferably made of injection-moulded polypropylene, polyethylene or other plastics material. The use of reground polypropylene is particularly preferred as this material has excellent properties and very low cost. The panel or label area is preferably in a glossy state. Other surfaces of the device may be rendered matt for example by spark erosion, however any desired form of finish can of course be used.

The illustrated device is designed to suspend and display a hand torch 13 shown in outline in FIG. 4. The torch has a generally cylindrical body 14 with an enlarged head 15 which is the illustrated embodiment is asymmetrical relative to the body 14. The head 15 has a rim or bezel 18 surrounding a recessed lens 33. Between the body 14 and head 15 is an eccentric tapered transition region 16 forming an oblique shoulder, e.g as shown in U.K. Design No. 1025931.

The shapes and dimensions of the legs 4, 5, the loop 6, and the tab 8 match the shape and dimensions of the torch. Specifically, the internal profile of the loop 6 matches the external profile of the tapered intermediate region 16 of the torch, in an oblique plane illustrated by the position of the loop 6 in FIG. 4. For additional security, this internal profile preferably extends through somewhat more than 180°, e.g. 190°, as can be seen in FIG. 1. The inner edges of the legs 4, 5 correspond to the longitudinal profile of the torch head 15 and may have oblique portions 17 to fit partly under the transition region 16.

The torch can therefore be fitted into the window formed between the legs 4, 5, the loop, and the panel, with its head resting over the loop 6 in the pivoted position shown in FIG. 4, and the torch and display device can then be hung from the slot 3.

To hold the torch securely in position, the tab 8 is pivoted from the rest position shown in FIG. 3, clockwise to the position shown in FIG. 4, in which the underside of the arm 11 rests against the lens of the torch, and the part-circular rim of the arm 11 rests against the inner surface of the torch rim 18, with the resilience of the hinge 9 pressing the arm 11 against the torch lens. In this condition, the torch cannot easily fall out of the display device, but it can be removed relatively easily by a prospective purchaser for inspection and handling.

The hinges 7, 9 are live hinges, that is to say they are inherently resilient so as to return the loop 6 and tab 8 to the positions shown in FIG. 3. In the case of a moulded plastics display device, these hinges are formed by regions in which the plastics material is of reduced thickness.

For inserting the torch in the device, the torch body 14 is passed between the legs 4, 5 and through the loop 6 with the device in the condition shown in Figure 3, until the intermediate transition region 16 is seated in the loop 6, then the torch is turned anticlockwise (as seen in FIGS. 3 and 4), pivoting the loop 6 anticlockwise and pushing the tab 8 clockwise until the tab clicks into place inside the torch rim, in the position shown in FIG. 4.

It will be seen that the cross-section of the loop 6 has an internal profile matching the junction between the torch body 14 and transition region 16. The loop 6, legs 4, 5, and tab arm 11 all fit closely against the torch in the position show in FIG. 4, so that the torch is reliably held in place against accidental dislodgement.

The described display device can be manufactured cheaply and simply, holds the torch reliably and safely, is easy to fit to the torch, and allows a customer easily to inspect the torch and if desired, to remove it for handling. The device can also be used as a convenient way of storing the torch, for example hanging by the slot 3 from a nail or hook.

FIGS. 6 and 7 illustrate a generally similar display device designed to accommodate a flat pocket torch 30, for example a torch as shown in U.K. Registered Design No. 1025932.

This torch has a flat body 31 with semi-circular edges, and a flared head 32 incorporating a recessed oval lens surrounded by an oval rim. The general configuration of the device resembles that of FIGS. 1 to 4, however the internal profiles of the legs 4, 5 and the loop 6 are shaped to match the external configuration of the flattened torch body and its flared head, and the retaining arm 11 of the tab 8 is short and has a straight edge, matching the straight longer edges of the oval rim of the torch lens. The use of the device is substantially identical to that described in relation to FIGS. 1 to 4.

FIGS. 8 to 11 illustrate a further inventive suspension display device for a flat torch, such as the torch illustrated in U.K. Registered Design No. 1025930.

This torch 26 has a flat generally cuboidal body 27 with rounded edges, of uniform cross section throughout its length. The lens 28 is in one of the major faces of the body at one end, and a retractable carrying loop 29 at that end of the body, when pulled or pivoted out, extends generally in the plane of the torch body.

The display device in this case comprises a panel 1, for example of injection moulded polypropylene, with a hanging slot 3, below which a fixed loop 20 projects downwards, in a plane offset from the plane of the panel 1. The limbs 21 of the loop are attached to the rear surface of the panel, by brackets 22, projecting inwards from which are lugs 23 set back from the surface of the panel to form a slot between them and the panel.

To attach the torch to the display device, the carrying loop or handle 29 of the torch is pulled out, and pushed into the slot defined between the lugs 23 and the rear surface of the panel 1, insertion being limited by a stop rib 24 on the rear surface of the panel. Ribs 25 on the legs 21 hold the torch in position for example by engaging shoulders, corrugations or dimples on the torch body. The legs 21 are resilient, holding the ribs 25 pressed against the torch body so that the torch is held in place by friction and/or positively. In a preferred arrangement, the carrying loop of the torch is hinged and when retracted, lies in a recess of the torch body so as to be flush with the rear surface of the torch body. When pivoted to its open position, the handle reveals the recess and this recess contains a step or shoulder 34 (normally invisible when the carrying loop is retracted), which seats on the ribs 25 to hold the torch in position.

What is claimed is:

1. A display and packaging device comprising a generally flat body portion capable of being suspended, a generally semi-circular dependent loop pivotable on the body portion about an axis arranged to be horizonal when the body portion is suspended, for embracing a portion of the circumference of an article to be packaged and displayed, and a flap or tab above the loop, also pivotable on the body portion about a horizontal axis, for seating against an upper region of the article, whereby the loop and tab together hold the article for display at one end thereof whereby the article depends downwardly from the device in a manner allowing easy removal and replacement of the article.

2. A display and packaging device as claimed in claim 1 in which the flap or tab, and the loop, are arranged to pivot in opposite directions.

3. A display and packaging device for a torch having a body with a lateral abutment adjacent a lens end of the torch, a recessed lens in the said end, and a rim for the lens, which device comprises:

a generally flat body portion adapted to be suspended;

a dependent loop of substantially half-circle extent, having its ends attached to the body portion with the body portion extending above the loop thereby defining a window between the loop and the body portion, the loop having a torch-holding position in which it extends obliquely to one side of the vertical when the body portion is suspended, the loop when in the said position being arranged to engage laterally and under the said abutment of a torch inserted in the window with its lens uppermost, whereby the torch is suspended in the loop; and a tab attached to the body portion within the upper region of the window and having a torch-retaining position in which it extends to the other side of the vertical when the body portion is suspended, in which position it is arrange to seat over the lens and against the inner side of the rim of a torch suspended in the loop, for retaining the torch.

4. A display and packaging device as claimed in claim 3 in which at least one of the loop and the tab has a rest position substantially coplanar with the body portion.

5. A display and packaging device as claimed in claim 4 in which at least one of the loop and the tab is hinged to the body portion about a hinge axis arranged to be horizontal when the body portion is suspended.

6. A display and packaging device as claimed in claim 4 in which the loop is hinged by its ends on lower ends of respective dependent limbs of the body portion and the tab is hinged to the body portion between the said limbs.

7. A display and packaging device as claimed in any preceding claim in which the inner surface of the loop extends through more than 180°.

8. A display and packaging device comprising a generally flat body portion capable of being suspended, a generally semi-circular dependent loop pivotable on the body portion about an axis arranged to be horizontal when the body portion is suspended, for embracing a portion of the circumference of an article to be packaged and displayed, and a flap or tab above the loop, also pivotable on the body portion about a horizontal axis, for seating against an upper region of the article, in which the flap or tab, and the loop, are arranged to pivot in opposite directions, and in which the loop is hinged by its ends on lower ends of respective dependent limbs of the body portion and the flap or tab is hinged to the body portion between the said limbs, whereby the loop and tab together hold the article for display in a manner allowing easy removal and replacement of the article.

* * * * *